US006303560B1

(12) United States Patent
Hartan et al.

(10) Patent No.: US 6,303,560 B1
(45) Date of Patent: Oct. 16, 2001

(54) COMPACTED DISINTEGRANT GRANULATE FOR COMPRESSION-MOLDED ARTICLES, ITS PRODUCTION AND ITS USE

(75) Inventors: Hans-Georg Hartan, Kevelaer; Juergen Souren, Stolberg; Elke Philippsen-Neu, Cologne; Rainer Poeschmann, Toenisvorst, all of (DE)

(73) Assignee: Stockhausen GmbH & Co. KG, Krefeld (DE)

( * ) Notice: Subject to any disclaimer, the term of this patent is extended or adjusted under 35 U.S.C. 154(b) by 0 days.

(21) Appl. No.: 09/534,455

(22) Filed: Mar. 27, 2000

(30) Foreign Application Priority Data

Mar. 29, 1999 (EP) ..... 99106370

(51) Int. Cl.[7] ..... C11D 17/00

(52) U.S. Cl. ..... 510/446; 510/473; 510/294; 510/298; 510/224; 510/113; 510/340

(58) Field of Search ..... 510/473, 446, 510/294, 298, 224, 113, 340

(56) References Cited

U.S. PATENT DOCUMENTS 5,900,399 * 5/1999 Seiter et al. ..... 510/446
6,051,545 * 4/2000 Boskamp ..... 510/446

* cited by examiner

*Primary Examiner*—Gregory Delcotto
*Assistant Examiner*—Hai Vo
(74) *Attorney, Agent, or Firm*—Oblon, Spivak, McClelland, Maier & Neustadt, P.C.

(57) ABSTRACT

A compacted granulate and a method for making the same, comprises 60–99 wt.-% of a water-insoluble, water-swellable cellulose and optionally at least one water-swellable polysaccharide derivative, 1–40 wt.-% of at least one polymeric binder of a polymer or a copolymer of (meth)acrylic acid and/or salts thereof, and at least one liquid surfactant, in which the granulate has a water content of from 2 to 8 wt.-%. These granulates are useful as disintegrants for detergent tablets, cleaner tablets, water-softening tablets, and stain removing salt tablets

35 Claims, No Drawings

COMPACTED DISINTEGRANT GRANULATE FOR COMPRESSION-MOLDED ARTICLES, ITS PRODUCTION AND ITS USE

BACKGROUND OF THE INVENTION

1. Field of the Invention

The invention relates to disintegrant granulate compositions of cellulose and optionally cellulose/starch derivatives, polymeric binders and gel-forming surfactants, as well as methods for making these compositions. These disintegrant granulate compositions are suitable, for example, as disintegrants for detergent tablets and granulates.

Disintegrants for tablets or granulates are auxiliary agents which promote the disintegration of tablets or granulates upon contact with liquids, particularly water. The purpose of the disintegrant is to cause and enhance both the disintegration of tablets into coarse fragments, as well as the subsequent disintegration of the coarse fragments into smaller particles. In the case of detergent tablets or granulates, the use of a disintegrant ultimately results in the dissolution and/or dispersion of all of the detergent components.

Tablets are produced by compressing a starting granulate using, such that the bulk density of the granulate, which is about 900 g/l in compact detergents, for example, rises to 1200 g/l after tabletting. As a rule, such tablets, which have higher densities than the starting granulate, have poorer solubility and reproducibility compared to the starting granulate. The addition of disintegrants promotes the desired rapid dissolution, or disintegration and dissolution of such tablets.

Depending on the composition of detergents and cleaners, the molding pressures required in tabletting can vary. Thus, the type of builder used, e.g. phosphate, zeolite, disilicate or layered silicate, may require various different molding pressures, so that tablets having varying hardness or compactness are formed. In order to safely protect the tablets against external mechanical impact, e.g. against breaking during transportation or when dropped, they should have a strength of 50 N or more.

Two ways of introducing a detergent tablet into a washing machine are normally possible: placing the tablet into the wash-in chamber of the washing machine, or into the washing drum of the washing machine. The requirements for tablet disintegration will vary depending on where the tablet is introduced into the washing machine.

Introduction into the wash-in chamber is the easiest method for the user and provides a higher quality washing process. However, this method places exceedingly high demands on the disintegration rate of the tablet. Specifically, the first step of tablet disintegration into coarse fragments must proceed very quickly because otherwise, tablet residues remain in the wash-in chamber and will not be utilized in washing. In modem washing machines, a time period of about 30 seconds normally is available for content of the tablets to be washed into the washing drum of the washing machine, via the wash-in chamber. In addition, this disintegration must occur within this 30 second period in both hot or cold wash-in water. When the detergent tablet is placed directly into the washing drum, the conditions for tablet disintegration are quite different because both mechanical friction and increasing water temperatures assist in the tablet dissolving process This problem of highly compacted moldings having long disintegration times is well-known in the field of pharmaceutical preparations. A large number of compounds and mixtures are known as tablet disintegrants in pharmaceutical practice. Several modes of operation have been discussed for tablet disintegrants, such as evolution of gas bubbles (effervescent powders), mutual repulsion of particles, transport of water (wicking effect), and a swelling/expansion due to absorption of water.

Many compounds which undergo massive swelling upon exposure to water are known. However, the swelling rate of these compounds is frequently is too slow to be of practical use. In addition to swelling rate and swelling volume of such compounds, the swelling pressure is of particular importance. There are various known methods for measuring these properties. It is possible to measure the expansion with no counter-pressure, and also to measure the swelling pressure with no expansion. Combined methods of measuring, wherein both the swelling pressure and the expansion are detected, are particularly suited in making predictions as to the suitability of disintegrants in tablets. One such method is the measurement of the swelling kinetics of the disintegrant, where the time dependence of the expansion under load of a disintegrant is determined. Hence, both swelling pressure and expansion are included in the results. Products suitable as disintegrants are also known to undergo either linear or non-linear expansion during the swelling process. Owing to their more rapid effect, disintegrants which undergo nonlinear swelling are markedly superior to disintegrants which undergo linear swelling.

2. Discussion of the Background

As can be inferred from the statements in WO 98/55575 regarding the prior art, the disintegrants known in the production of drug tablets may also be used in the field of detergents and cleaners.

DE-OS 2,251,249 describes rapidly disintegrating drug tablets, for example, which are produced by compressing a drug granulate and a disintegrant granulate. The use of granular starting materials results in a porous tablet structure. A starch-based disintegrant granulate having a particle size of from 2.0 to 0.3 mm is used as an example.

DE-OS 2,355,204 reports drug tablets which for tablet stability reasons are compressed from granular starting components adjusted to a moisture content of less than 2%, prior to compression.

U.S. Pat. No. 3,629,393 claims drug tablets with delayed release of the active ingredient, which are compressed from granular components, including granular disintegrants comprised of high molecular weight water-swellable compounds such as cellulose derivatives. The examples describe granulate dimensions of around 0.84 mm.

U.S. Pat. No. 4,072,535 describes the use of disintegrants made of pre-compacted starch in pharmaceuticals and detergents. The grain size of the compacted material is from 0.05 mm to 0.42 mm, the moisture content is reported to be 9–16%, preferably 11–13%. The disintegration times of the exemplary tablets are around several minutes.

DE-OS 2,321,693 reports detergent tablets containing from 1 to 25 wt.-% of fibrous cellulose as disintegrant. In the examples, tablets containing compacted cellulose granulates have astrength of from 15 to 19 N.

EP 0,170,791 describes tablet-shaped detergent additives compressed from granulate components, having from 1 to 5 wt.-% of granulate tablet disintegrants based on crosslinked polyvinylpyrrolidone and/or cellulose ethers. The granulate should be free of dusty components. The tablets have breaking strengths of from 50 to 120 N and long dissolution times of several minutes.

WO 98/40463 reports moldings having detergent or cleaning activity, which are produced using a disintegrant granulate having a high adsorptive capacity for water and a grain size distribution in which at least 90 wt.-% of the grains have a particle size of 0.2 mm to 3 mm. The fraction of dust particles having a particle size <0. 1 mm is below 1 %. The disintegrant granulate contains at least 20 wt.-% of disintegrants such as starch, starch derivatives, cellulose, and cellulose derivatives. According to the teaching of this patent, the presence of anionic or non-ionic surfactants has a negative effect on the tablet disintegration time. The granulate is produced in a conventional fashion, such as by spray drying, superheated steam drying of aqueous formulations, or by granulating, pelletizing, extrusion, or roll compacting of powdered components. There is no detailed processing data as to the granulation process or other processing steps following granulation to form the disintegrant granulate. The detergent tablet produced as an example includes a disintegrant based on compacted cellulose made of thermomechanically treated wood material and has a tablet hardness of 45 N. Tablets having higher strength, i.e. more than 50 N, were not described.

WO 98/55575 describes an auxiliary agent granulate for moldings having detergent and cleaning activity. The claimed auxiliary agent granulates include from 10 to 95 wt.-% of cellulose having a particle size below 0.1 mm and from 5 to 90 wt.-% of microcrystalline cellulose. According to the Examples, the celluloses in the auxiliary agent granulates are partially combined with carboxymethylcellulose, N,N,N',N'-tetraacetylethylenediamine (TAED) and citric acid/bicarbonate. The grain size of more than 90 wt.-% of the compacted material is from 0.3 to 2.0 mm, and 0.2 mm in less than 5 wt.-% of the compacted material. There are no dusty components. Roller compaction of the dry pre-mixture is the preferred method of production. WO 98/55575 does not provide detailed processing data for the production of the granulate. The examples show that detergent tablets which have the auxiliary agent granulates, have low strengths of 35 N or less. More stable, more highly compacted tablets having higher strengths of at least 50 N are not described.

The unpublished European Patent Applications 98 121 397.8 and 98 121 392.9 claim cellulose/cellulose derivatives and starch/starch derivatives, respectively, together with thickening surfactants and fine particulate polymers of (meth)acrylic acid in a compacted, granulate form as a disintegrant granulate component of detergents and cleaners, softeners, and stain removing salts produced in the form of tablets. The granulates have non-linear swelling kinetics such that—with respect to the overall swelling process—a massive increase in volume occurs during the initial phase of the swelling process. This reference does not describe the dissolution behavior of the tablets in the wash-in chamber of a washing machine.

The patent application WO 98/40462 describes a pellet made of powdered and/or granulate ingredients, particularly detergent ingredients, and includes particles of a cellulose-containing material, which may also be present in compacted form, acting as a disintegrant.

Particularly preferred cellulose components include pulps treated by thermomechanical (TMP) and chemithermomechanical (CTAP) processes. The particle size of the compacted disintegrant may range from 0.2 to 6 mm. Surfactants may also be added to the pellet via the cellulose component, for example at a level of 0.5 to 5% of surfactant/pellet. This corresponds to a surfactant content of about 1445 wt.-% in the cellulose disintegrant, based on the reported 3 to 6%/pellet concentrations of cellulose disintegrant in the compacted granulate. This reference does not provide detailed process or technical information regarding the production of the disintegrant granulate or its function in the pellet.

According to EP 0,750,662 B1, the production of cleaning tablets having high breaking strength and storage stability is possible when the components of the mixture are first made hydrophobic, and the tablets are then produced without water. These tablets do not include any disintegrant granulates and have breaking strengths of >150 N, but they exhibit highly delayed dissolution behavior.

The prior art also includes the products marketed by the company Degussa AG, designated Elcema G250 and Elcema G400, which consist of pure compacted cellulose, and have been used as tablet disintegrants since 1971. These products are produced using dry granulation and have a particle size of from 0.03 up to 0.40 mm. The moisture content is less than about 6%.

SUMMARY OF THE INVENTION

It is therefore the object of the invention to provide a disintegrant granulate for tablets which is superior compared to the prior art. In particular, this granulate should undergo rapid and massive swelling in such a way that tablets produced therewith are largely dissolved in the wash-in chamber of washing machines during the short water wash-in period.

Furthermore, the disintegrant granulate should have high abrasion strength, and its effectiveness should not be limited by amounts of fines and particularly dust inevitably arising during its production process. Moreover, in tablets having high strengths of more than 50 N, the disintegrants should ensure a combination of good disintegrating effect and good solubility, and ageing phenomena in the form of an attenuation of properties should be small when storing the tablets for several weeks. In addition, a process for the production of said disintegrant granulates and their use in tablets for washing and cleaning processes is provided.

DETAILED DESCRIPTION OF THE INVENTION

The object of the present invention is accomplished by means of a compacted disintegrant granulate for tablets, constituted of:

A) 60–99 wt.-% of a cellulose which is insoluble in water and swellable in water, and optionally, other modified water-swellable polysaccharide derivatives;

B) 1–40 wt.-% of at least one polymeric binder in the form of a polymer product or a copolymer product of (meth) acrylic acid and/or salts thereof;

C) 0–7 wt.-% of at least one a liquid surfactant forming a gel with water;

wherein the sum of A), B) and C) amounts to 100 wt.-%, characterized in that the disintegrant granulate has a moisture content of from 2 to 8 wt.-%.

Surprisingly, the disintegrant compacted products were found more effective when having a specific water content. According to the teaching of prior art and practical experience, a water content in the final granulate which is as low as possible might have been expected to provide the best swelling effect.

Component A:

A water-insoluble, swellable cellulose may be used. Fibrils of native cellulose having a maximum length of 0.30 mm were found particularly suitable. Both microcrystalline and amorphous, fmely particulate cellulose and mixtures thereof can be used. 2V The finely particulate cellulose preferably has bulk weights of from 40 g/l to 300 g/l, and includes bulk weights of 50, 60, 70, 80, 90, 100, 110, 120, 130, 140, 150, 160, 170, 180, 190, 200, 210, 220, 230, 240, 250, 260, 270, 280, and 290 g/l, more preferably from 65 g/l to 170 g/l, inclusive of all values and subranges therebetween. When using types which have already been granulated, their bulk weight is higher and can be from 350 g/l to 550 g/l in an advantageous embodiment, including bulk weights of 360,370, 380, 390, 400,410,420, 430, 440, 450,460, 470, 480, 490, 500, 510, 520, 530, and 540 μl, inclusive of all values and subranges therebetween. Typically, the bulk weights of the cellulose derivatives range from 50 g/l to 1000 g/l, including bulk weights of 100, 150, 200, 250, 300, 350, 400, 450, 500, 550, 600, 650, 700, 750, 800, 850, 900, and 950 μl, inclusive of all values and subranges therebetween, preferably from 100 g/l to 800 g/l.

The particle size of the finely particulate cellulose preferably is between 0.030 mm and 0.20 mm, including 0.040, 0.050, 0.060, 0.070, 0.080, 0.090, 0.10, 0.1 1, 0.12, 0.13, 0.14, 0.15, 0.16, 0.17, 0.18, and 0.19 mm, inclusive of all values and subranges therebetween, and the preferred average particle size in granulated types is between 0.350 mm and 0.800 mm, including 0.400, 0.450, 0.500, 0.550, 0.600, 0.650, 0.700, and 0.750 mm, inclusive of all values and subranges therebetween. The particle size of the finely particulate cellulose derivatives preferably is from 0.030 mm to 3.0 mm, including 0.040, 0.050, 0.060, 0.070, 0.080, 0.090, 0.100, 0.150, 0.200, 0.250, 0.300, 0.350, 0.400, 0.450, 0.500, 0.550, 0.600, 0.650, 0.700, 0.750, 0.800, 0.850, 0.900, 0.950, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, and 2.9 mm, inclusive of all values and subranges therebetween.

The amount of cellulose in the disintegrant granulate is between 60 and 99 wt.-%, including 65, 70, 75, 80, 85, 90, and 95 wt.-%, inclusive of all values and subranges therebetween, preferably between 60 and 95 wt.-%.

In a particular embodiment of the invention, regenerated celluloses such as viscose are also used. Regenerated celluloses in a powdered form are especially remarkable for their good water absorption. The viscose powder can be produced from cut viscose fibers or by precipitation of dissolved viscose. For example, low molecular weight cellulose degraded by electron beam is also suitable in the production of the disintegrant granulate. In an advantageous embodiment, plasticized regenerated fibers are used. For example, glycerol is a typical plasticizer for these products.

In an advantageous embodiment, the granulates according to the invention may include water-swellable polysaccharides derivatives, including water-swellable cellulose derivatives such as cellulose ethers and cellulose esters, and water-swellable starch or starch derivatives, as well as polygalactomannans. For example, such water-swellable polysaccharide derivatives may include ionically modified celluloses and starches such as carboxymethyl-modified cellulose and carboxymethyl-modified starch, nonionically modified celluloses and starches like alkoxylated celluloses and starches such as hydroxpropyl- and hydroxyethylstarch or hydroxpropyl- and hydroxyethylcellulose, and alkyl-etherified products such as methylcellulose, as well as mixed modified celluloses and starches, modified as described above, optionally combined with a crosslinking modification step. Also, suitable starches are cold-swelling starches formed by mechanically or chemically degrading the starch grain. Above all, these include swelling starches made by extruder and roller drying processes, as well as products modified enzymatically, by oxidation or acid degradation. Chemically derivatized starches preferably contain substituents linked in sufficient number to the polysaccharide chains by ester and ether groups.

Starches modified with ionic substituents such as carboxylate, hydroxyalkyl or phosphate groups were found particularly advantageous and therefore, they are preferred. Also, the use of slightly pre-crosslinked starches was found beneficial in improving the swelling behavior. As a result of their good cold water swellability, alkaline-treated starches may also be used.

In an advantageous embodiment, a combination of cellulose and cellulose derivatives and/or starch and/or starch derivatives has proven successful. The quantity ratios may vary within wide limits, and the percentage of cellulose derivatives and/or starch and/or starch derivatives preferably is from 0.1 to 85 wt.-%, more preferably from 5 to 50 wt.-%, relative to the combination.

Component B:

Polymers or copolymers of (meth)acrylic acid or mixtures of such polymers or copolymers are used as binders in the granulate. The polymer products are selected from the group of homopolymers of (meth)acrylic acid, from the group of copolymers with the following monomer components: ethylenically unsaturated dicarboxylic acids and/or anhydrides thereof, and/or ethylenically unsaturated sulfonic acids and/or acrylic esters and/or vinyl esters and/or vinyl ethers or saponification products thereof, and/or crosslinkers and/or graft base materials based on polyhydroxy compounds.

Non-crosslinked polymers or copolymers of (meth) acrylic acid having weight average molecular weights of from 5,000 to 70,000 were found particularly suitable, including molecular weights of 6,000, 7,000, 8,000, 9,000, 10,000, 15,000, 20,000, 25,000, 30,000, 35,000, 40,000, 45,000, 50,000, 55,000, 60,000, and 65,000, inclusive of all values and subranges therebetween. These copolymers preferably are copolymers of (meth)acrylic acid and ethylenically unsaturated dicarboxylic acids or anhydrides thereof, such as maleic acid or maleic anhydride, and contain e.g. from 40 to 90 wt.-% of (meth)acrylic acid and from 60 to 1 0 wt.-% of maleic acid or maleic anhydride, the relative molecular weight of which, based on free acid, ranging between 3,000 and 100,000, preferably from 3,000 to 70,000, and more preferably from 5,000 to 50,000. Likewise, ter- and quaterpolymeric polycarboxylates constituted of (meth)acrylic acid, maleic acid and optionally, completely or partially saponified vinyl alcohol derivatives, or those constituted of (meth)acrylic acid, ethylenically unsaturated sulfonic acids and polyhydroxy units such as sugar derivatives, or those constituted of (meth)acrylic acid, maleic acid, vinyl alcohol derivatives, and monomers containing sulfonic acid groups were found to be well-suited binders. Examples of suitable polymer products can be seen in the patent specifications DE 43 00 772, DE 42 21 371, and WO 95/17444.

In production, the polymeric binders preferably are employed in the form of their aqueous solutions, but may also be used in the form of finely particulate powders. The binder e polymers preferably are present in a partially or completely neutralized form, with salt formation preferably being effected using cations of alkali metals, ammonia and amines or 152 mixtures thereof. The percentage of polymers/copolymers in the disintegrant is between 1 and 40 wt.-%, including 2, 3, 4, 5, 10, 15,20,25, 30, and 35 wt.-%, inclusive of all values and subranges therebetween, preferably between 1 and 20 wt.-%, and more preferably between 5 and 15 wt.-%. Polymer percentages above 15% in the disintegrant result in harder disintegrant granulates, while polymer amounts below 1% tend to form soft granulates which are less resistant to abrasion.

Crosslinked polymers of (meth)acrylic acid are also suitable polymer binders. They are preferably used as finely particulate powders and preferably have an average particle size of from 0.045 mm to 0.150 mm, including 0.050, 0.055, 0.060, 0.065, 0.070, 0.075, 0.080, 0.085, 0.090, 0.095, 0.100, 0.110, 0.120, 0.130, and 0.140 mm, inclusive of all values and subranges therebetween, and preferably are employed at 0.1 to 10 wt.-%, including 0.2, 0.3, 0.4, 0.5, 0.6, 0.7, 0.8, 0.9, 1, 2, 3, 4, 5, 6, 7, 8, and 9 wt.-%, inclusive of all values and subranges therebetween. While particles having an average particle size of more than 0.150 mm also provide good disintegrant granulates, they give rise to swelled bodies visible as particles when dissolving the tablets produced using said granulates, which bodies, e.g. in case of textile washings, undergo undesirable, clearly visible deposition on the textile material.

A special embodiment of the invention is represented by the combination of soluble poly(meth)acrylate homo- and copolymers and the previously mentioned finely particulate, crosslinked polymer particles.

The so-called polymer surfactants are also suitable co-binders which, at the same time, have surfactant characteristics. These are understood to be reaction products which, in addition to the typical polymer structures of the above-mentioned binder polymers, have structural elements which provide a surfactant effect. For example such polymer surfactants may include graft polymers with alkoxylated fatty alcohol, or carboxylate-containing polymers including methoxyalkylene oxide monomer units, and also, maleic acid/vinyl ether/long-chain fatty amine copolymers, as well as semiamides of maleic acid copolymers and copolymers of acrylic acid and long-chain acrylates. In a preferred embodiment, the polymer surfactants contain alkylene oxide units. The polymer surfactants can be present in amounts of up to 30 wt.-% in the disintegrant granulate.

In the production of the disintegrant granulates according to the invention, the above-mentioned polymer surfactants were found suitable when used alone, with no polymeric binder component and with no surfactant component present. The required amounts of polymer surfactant in the disintegrant granulate range from 1 to 40 wt.-%, including 2, 3, 4, 5, 10, 15, 20, 25, 30, and 35 wt.-%, inclusive of all values and subranges therebetween, preferably from 5 to 20 wt.-%.

Accordingly, the present object is also accomplished by means of a compacted disintegrant granulate for tablets, constituted of A) 60–99 wt.-% of a water-insoluble cellulose which is swellable in water, and optionally, other modified water-swellable polysaccharide derivatives;

D) 1–40 wt.-% of at least one polymeric binder; wherein the sum of A) and D) amounts to 100 wt.-%, characterized in that the disintegrant granulate has a moisture content of from 2 to 8 wt.-%, and the polymeric binder D) is a polymer surfactant Component C:

As another ingredient, the disintegrant granulate includes one or more liquid surfactants forming gels with water, selected from the group of non-ionic, anionic or amphoteric surfactants present in amounts of up to 7 wt.-%, including 0, 0.5, 1, 1.5, 2, 2.5, and 3 wt.-%, inclusive of all values and subranges therebetween, preferably up to 3.5 wt.-%. An excessively high surfactant content in the disintegrant results in poorer swelling properties in addition to increased abrasion in the tablets produced therewith.

For example, the non-ionic surfactants can be alkylpolyglucosides, fatty acid alkylolamides, fatty acid polyethyleneglycol esters, fatty amine oxyethylates, fatty alcohol ethoxylates having 3–15 mol ethylene oxide or propylene oxide, fatty acid glycerides, sorbitan esters, saccharose esters, e.g. saccharose palmitate, pentaerythritol partial esters which may also be ethoxylated, as well as alkylphenol polyethyleneglycol ethers or phenol polyethyleneglycol ethers.

For example, the anionic surfactants can be alkyl sulfates, linear and branched alkylbenzenesulfonates, alkylglycerol ethers, fatty alcohol polyethyleneglycol ether sulfates, paraffinsulfonates, α-olefinsulfonates, sulfosuccinates, phosphoric esters, or fatty alcohol ether carboxylates.

For example, the amphoteric surfactants can be coconut fatty acid amidopropylbetaine, modified imidazolines, or fatty acid amide derivatives having a betaine structure.

In a preferred embodiment of the invention, mixtures of surfactants are employed, and in another preferred embodiment, only non-ionic surfactants are used.

The granulate compact according to the invention is remarkable for its particular swelling kinetics, i.e., the expansion as a function of time does not vary in a linear fashion but rather, reaches a very high level after only a very short time. In this case, the swelling behavior within the first 10 seconds after contact with water is of particular interest. Within the 2 to 8 wt.-% range of water content according to the invention, there is an unexpectedly high volume expansion, a high expansion rate, and a high swelling pressure. This combination of properties results in short tablet disintegration times and a very good wash-in behavior in the dosing chambers of washing machines, for tablets containing the compacted disintegrant granulates of the present invention. In the wash-in tests, the superior effect of the agents according to the invention is seen in the fact that nearly all the tablets are disintegrated and washed away.

The specific water-absorbing capacity of the granulate according to the invention is very high and can be determined gravimetrically. The water absorption determined in this way is preferably from 500 to 2000%, including 600, 700, 800, 900, 1000, 1100, 1200, 1300, 1400, 1500, 1600, 1700, 1800, and 1900%, inclusive of all values and subranges therebetween.

Surprisingly, it has also been found that a specific amount of dust, which, according to the teaching of prior art, should not be present in granulates for detergent and cleaner tablets, does not represent an interference in the disintegrant compacted product of the invention and, in addition, contributes to good storage stability of the tablets produced. Amounts of fine dust having up to 10 wt-%, preferably up to 8 wt.-% of particles less than 0.1 mm in size may be present in the disintegrant granulates of the invention.

Compared to prior art products, the absorption of liquid (also referred to as specific porosity) of the disintegrant according to the invention is markedly increased, being in a range of more than 750 ml/kg, preferably in a range of from 800 to 1000 ml/kg. Such a high liquid absorption has a significant effect on the swelling performance and the transport of water in the disintegrant. On an average, prior art products have liquid absorption values of about 600 ml/kg.

Initially, the production of the disintegrant granulates of the invention is effected by mixing the granulate components according to the invention, using conventional mixing procedures. For example, mixers by the companies Vomm, Lödige, Schugi, Eirich, Henschel, or Fukae may be used. In this first step of mixing and granulating, precompounds are produced using agglomeration processes. These precompounds form a flowable material having a water content between 10 and 80 wt.-%. The required water content in the primary mixture depends on the compacting means which is used. A water content of at least 10%, preferably 20% is required to achieve good compacting and to ensure high liquid absorption in the subsequent dry granulate. With water contents between 60 and 80 wt.-%, care must be taken to prevent water from being pressed out of the mixture during the compressing process in certain compacting apparatus such as a ring matrix press, while these phenomena are not observed in extruders. Ultimately, the compacting technique must be adapted to the water content of the primary mixture. In ring matrix presses and pelletizing presses, a water content of from 20 to 60 wt.-%, including 25, 30, 35, 40, 45, 50, and 55 wt.-%, inclusive of all values and subranges therebetween, preferably from 20 to 40 wt.-% was found beneficial. Also, for economic reasons as well, the water content of the precompound should not be higher than required, because this water has to be removed in the subsequent drying process with input of energy.

In the next step, these precompounds are subjected to mechanical compacting. Final compacting is essential for the swelling and water absorbing behavior of the granulate according to the invention. Compacting using pressure may be effected in various ways. The products can be compacted e.g. in a smooth or patterned fashion between two working surfaces in roller compactors. The compacted product discharges in the form of a strand. Compacting methods in matrices using plugs or pad rollers result in compacted product forms such as tablets or briquettes. Roller compactors, extruders, roller or cube presses, as well as granulating presses may be used as compacting machines.

Compacting using a pelletizing press was found particularly suitable, and by means of a suitable process control, granulates are obtained which can be dried without further size reduction. For example, suitable pelletizing presses are produced by the companies Amandus Kahl and Fitzpatrick. As a result of compacting, a disintegrant granulate preferably is produced which has a bulk density of from 100 g/l to 500 g/l, more preferably from 150 g/l to 450 g/l, with 250 g/l to 400 g/l being particularly preferred. Because of the particularly good swelling properties, it was found beneficial to maintain a bulk density limit of 400 g/l at maximum. Surprisingly, the granulates were found to have high abrasion resistance even at such bulk densities.

The coarse, compacted particles are reduced in size, where e.g. mills, chippers or roller mills are suitable. Size reduction may be effected prior to or after drying, where the granulates of the invention preferably are adjusted to a particle size distribution of from 0.05 to 3 mm, more preferably from 0.1 to 1.5 mm.

The removal of dust fractions below 0.1 mm can be performed using common screening units, for example. Because dust percentages of up to 10 wt.-% do not represent an interference in most cases when using the granulates of the invention, their removal is often unnecessary. The water content according to the invention, being 2–8 wt.-%, preferably 2.5–7 wt.-%, and more preferably 3–5 wt.-%, is adjusted during the drying process. To this end, conventional dryers such as roller dryers (temperatures of e.g. 95–120° C.) or fluid bed dryers (temperatures of e.g. 70–100° C.) are suitable.

The invention encompasses the use of these compacted granulates as disintegrants for compressed moldings, e.g. tablets, cubes, balls and the like. The use as disintegrants for cleaner formulations, detergent formulations, stain removing salts, softeners in tablet or cube form is particularly preferred.

The moldings contain the disintegrant granulates according to the invention in amounts of from 0.5 wt.-% to 15 wt.-%/o, including 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, and 14.5 wt.-%, inclusive of all subranges and values therebetween, preferably from 3 wt.-% to 8 wt.-%, and more preferably from 4 wt.-% to 7 wt.-%.

The moldings of the invention have sufficient stability and strength and enable safe handling, packaging and storage. Upon contact with water, however, they should undergo rapid disintegration, so that the other components of the molding may have the desired effect. Sufficient stability to mechanical exposure is present for moldings at a breaking strength of from 50 N or higher. The granulates according to the invention impart excellent disintegration and dissolution characteristics to these highly compacted moldings. Such disintegration and dissolution characteristics are otherwise present only in moldings of low strength.

As a rule, the moldings for detergent formulations include builders, bleaching agents and bleaching activators, surfactants, tabletting aids, disintegrants, and other conventional additives and auxiliary agents.

Polyphosphates, pyrophosphates, metaphosphates or phosphonates, layered silicates, amorphous silicates, amorphous disilicates, and zeolite are possible as builders. Further components of the builder system can be fillers such as alkali carbonates, bicarbonates, e.g. sodium carbonate or sodium hydrogen carbonate, sesquicarbonates, sodium sulfate, magnesium sulfate, or citrate, citric acid, succinic acid, tartaric acid, and malic acid. Co-builders and dispersants frequently are also used as auxiliary builders. These co-builders or dispersants can be polyacrylic acids and sodium salts thereof.

Copolymers of (meth)acrylic acid and maleic acid, terpolymers and quaterpolymers of (meth)acrylic acid, maleic acid, vinyl alcohol and vinyl compounds containing sulfo groups may also be used. In particular, ter- and quaterpolymeric polycarboxylates produced from (meth)acrylic acid, maleic acid and vinyl alcohol or vinyl alcohol derivatives (such as described in DE 43 00 772 C2), or those produced from (meth)acrylic acid, 2-alkylallylsulfonic acid and sugar derivatives (such as described in DE 42 21 381 C1), or those produced from (meth)acrylic acid, maleic acid, vinyl alcohol derivatives and monomers having sulfonic acid groups (described in DE 195 16 957 A) are also preferred.

Polyethyleneglycol and/or polypropyleneglycol having a molecular weight of from 900 to 30,000 are used as additional components, as well as carboxylated polysaccharides, polyaspartates and polyglutamate. Mixtures including various organic builders such as citric acid are also possible.

Conventional bleaching agents to be used are sodium perborate tetrahydrate and sodium perborate monohydrate, sodium percarbonate, peroxypyrophosphates, citrate perhydrates, as well as peracid salts which form $H_2O_2$, peracids, as well as perbenzoates, peroxyphthalates, diperazelaic acid and diperdodecanedioic acids. The content of bleaching agents in the tablets preferably is 10–60 wt.-%, and particularly 15–50 wt.-%. Activators may be incorporated to achieve a good bleaching effect when washing at 60° C. and below.

Suitable bleaching activators are N-acyl and O-acyl compounds which form organic peracids with $H_2O_2$, preferably N,N'-tetraacylated diamines, carboxylic anhydrides and esters of polyols, such as glucose pentaacetate. Furthermore, acetylated mixtures of sorbitol and mannitol can be used. N,N,N,N'-tetraacetylethylenediamine (TAED), 1,5-diacetyl-2,4-dioxo-hexahydro-1,2,5-triazine (DADHTI) and acetylated sorbitolmannitol mixtures (SORMAN) are particularly suited as bleaching activators.

In addition to non-ionic, anionic and amphoteric surfactants, cationic surfactants may also be present in detergent formulations, e.g. quaternary ammonium compounds having $C_8$–$C_6$ N-alkyl or N-alkenyl groups and N-substituents such as methyl, hydroxyethyl or hydroxypropyl groups.

Also, tabletting aids are optionally used, e.g. polyalkyleneglycols and magnesium stearate.

Examples of other conventional detergent additives and auxiliary agents are enzymes, magnesium silicates, aluminum aluminates, benzotriazole, glycerol, magnesium stearate, polyalkylene glycols, hexametaphosphate, phosphonates, bentonites, soil release polymers, and carboxymethylcelluloses.

As a rule, dishwasher tablets as an embodiment of detergent formulations contain polyphosphates, pyrophosphates, metaphosphates, or phosphonates, layered silicates, amorphous silicates, amorphous disilicates, and zeolites as builders, as well as fillers such as sodium carbonate, sodium sulfate, magnesium sulfate, sodium hydrogen carbonate, citrate, and citric acid, succinic acid, tartac acid, and malic acid. Frequently, co-builders and dispersants are co-used as auxiliary builders. Such co-builders or dispersants can be polyacrylic acids or copolymers with polyactylic acid and sodium salts thereof.

Conventional bleaching agents are sodium perborate tetrahydrate and sodium perborate monohydrate, sodium percarbonate, peroxypyrophosphates, citrate perhydrates, as well as peracid salts which form $H_2O_2$, peracids, such as perbenzoates, peroxyphthalates, diperazelaic acid, and diperdodecanedioic acids. The content of bleaching agents in the tablets preferably is 10–60 wt.-%, including 15, 20, 25, 30, 35, 40, 45, 50, and 55 wt.-%, inclusive of a values and subranges therebetween, particularly 15–50 wt.-%. Likewise, low-foam non-ionic surfactants of the polyalkyleneglycol and alkylpolyglucciside types are employed.

Similarly, examples of other common cleaner additives and auxiliary agents are enzymes, magnesium silicates, aluminum aluminates, benzotriazole, glycerol, magnesium stearate, polyalkyleneglycols, hexametaphosphate, and phosphonates. As a rule, water-softening tablets are comprised of builders such as layered silicates, amorphous silicates, amorphous disilicates and zeolites, and fillers such as sodium carbonate, sodium sulfate, magnesium sulfate, sodium hydrogen carbonate, citrate, and citric acid.

Frequently, co-builders and dispersants are used as auxiliary builders. Such co-builders or dispersants can be polyacrylic acids or copolymers with polyacrylic acid and the sodium salts thereof.

Likewise, low-foam non-ionic surfactants of the polyalkyleneglycol and alkylpolyglucoside types are employed.

Examples of other common detergent additives and auxiliary agents are magnesium silicates, polyalkyleneglycols and phosphonates.

In a preferred embodiment, the disintegrant granulates of the invention permit the production of detergent tablets having disintegration times of up to 15 s at a tablet breaking strength of up to 80 N.

With reference to the embodiments, the invention will be illustrated in more detail below. All figures are by weight, unless otherwise stated in individual cases.

Testing Methods

Determination of the Specific Water-Absorbing Capacity

The specific water-absorbing capacity of the granulate according to the invention can be determined gravimetrically as follows:

A defined amount of granulate (e.g. 2.00 g) is welded in a thin paper bag, such as a tea bag, and immersed in a vessel containing an excess of distilled water. After a 3 minute immersion time, the bag is taken out of the water and suspended for 10 minutes to drain. The bag is weighed, and the water absorption in the presence and absence of granulate is determined from the weight difference of wet bags containing the granulate, compared to wet bags which do not contained the granulate.

Determination of the Swelling Kinetics

To determine the swelling rate and swelling height under load, 3.00 g of granulate is placed in a cylindrical plastic vessel having an inner diameter of 60 mm and covered with a water-permeable fleece. Depending on the bulk weight, the layer thickness of the granulate is 1–3 mm. A movable piston having a through-boxing and a weight of 58 g is placed on the fleece and connected to a path measuring instrument which records the path of the piston as a function of time. The granulate is caused to swell by adding 70 ml of water, and the shift of the piston thus induced (path) is determined as a function of time and evaluated graphically.

Determination of Liquid Absorption (Specific Porosity)

The specific porosity of the disintegrant granulate is determined using a well-known standard method of determining the porosity level of solids. The principle of said method is as follows:

The solid is completely soaked with di-n-butyl phthalate (DBP) and subsequently, the liquid absorbed in the pores after a defined period of time under defined conditions is removed by centrifuging. The amount of absorbed DBP is regarded as a measure for the porosity of the solid.

Procedure:

3 g of sample is weighed in a commercially available, tared G3 glass filter crucible and 10 ml of DBP is added. These crucibles are placed in a beaker lined with filter paper at its bottom. Precisely after 5 minutes, the glass filter crucibles are weighed, subsequently placed in Teflon holders and centrifuged for 5 minutes at 1800 rpm. Following centrifuging, the crucibles are removed from the Teflon holders and weighed again.

The porosity is calculated according to the following formula:

$$P = \frac{(M2 - M1) \times 1000}{\text{Density} \times E}$$

| | | |
|---|---|---|
| $P$ | = | Absorbing capacity in ml DBP per kg of solid (porosity) |
| $M2$ | = | weight, in grams, of crucible with moist sample after centrifuging |
| $M1$ | = | weight, in grams, of crucible with dry sample with solvent |
| Density | = | 1.050 g/ml DBP |
| $E$ | = | initial weight of sample in grams |

Method of Determining the Tablet Disintegration Time

A tablet for washing and cleaning having a content of 5% disintegrant is used in the test. 500 ml of soft water having a temperature of 23° C. is placed in a beaker, equipped with a metal screen having a mesh width of 4 mm mounted at a height of 10 cm. A magnetic stirring bar in the beaker is set in motion at about 200 rpm, and a tablet is placed on top of the screen. The time from the beginning of tablet addition until tablet disintegration is measured using a stopwatch. Disintegration is reached when all the tablet fragments have fallen through the screen.

Testing Conditions for Wash-In Tests on Detergent Tablets in Washing Machines:

Three tablets are placed in line in the wash-in chamber of a washing machine. The washing machine is connected to a 5 bar tap water pressure line and started using the 60° C. normal program. The wash-in time is 30 seconds, where the machine takes up water only once. The test is performed four times in total, so that 12 tablets are employed. The remaining tablets are counted after each wash-in process. The total amount of tablets which have not been washed in is reported.

Determination of the Tablet Breaking Strength

To determine the tablet breaking strength, a type TB30/TBH30MD tablet breaking strength tester by Erweka Company is used, where the breaking strength is determined using a strain gauge having a force measuring capsule. The measuring accuracy is ±1 N. Following appropriate programming, the tablet is placed in the measuring device and the measuring procedure is started. The instrument indicates the breaking strength value.

Abrasion Test for Disintegrant Granulates 100 g of dried disintegrant granulate having a particle size of >1 mm is placed in a 500 ml beaker. A metal dissolver disc 3.5 cm in diameter and connected to a stirrer motor is immersed in the granulate. The stirrer motor is adjusted to 800 rpm, and stirring is effected for one minute, where the granulate undergoes more or less significant abrasion. After this time, the grain fraction percentage having <1 mm is determined using screen analysis. The fraction having <1 mm is reported as a percentage of the total amount.

EXAMPLE

Having generally described this invention, a further understanding can be obtained by reference to certain specific examples which are provided herein for purposes of illustration.

Examples M1–M7 and Comparative Examples C1–C5

The disintegrants used in the Examples were produced by wet-compacting on a pelletizing press supplied by the Amandus Kabl Company. The compression level was adjusted to be 1:3. The water content of the mixtures prior to compressing can be inferred from Table 1. Following compacting, the granulates were dried to the indicated moisture content on a roller dryer from Babcock Company. Comparative Example C5 was produced without additional water on a WP 150 roller press from Alexanderwerke. The molding pressure was adjusted to 1.1 tons/cm$^2$ . The granulates were reduced on a friction chipper. Drying was effected on a belt dryer.

The granulates have particle sizes between 0.3 and 2 mm, and the dust fraction below 0.1 mm is reported in the Table.

TABLE 1

Formulations in % by weight used to produce disintegrants, and properties of the granulates

| Disintegrant | C1 | C3 | C4 | C5 | M1 | M2 | M3 | M4 | M5 | M6 | M7 |
|---|---|---|---|---|---|---|---|---|---|---|---|
| Cellulose* | 50 | 50 | 50 | 80 | 50 | 50 | 45 | 50 | 47 | 40 | 50 |
| Linear PAA** | 12.5 | 12.5 | 12.5 | 20 | 12.5 | 12.5 | 10 | 10 | 12.5 | 10 | — |
| Crosslinked PAA*** | | | | | | | | 2 | | | — |
| CMC### | | | | | | | 15 | 5 | 10 | 20 | — |
| Nio surfactant## | 0.5 | 0.5 | 0.5 | 0 | 0.5 | 0.5 | 0.5 | 0.5 | 0 | 0.5 | — |
| Polymer surfactant# | | | | | | | | | | | 12.5 |
| Water used for compacting (wt. %) | 37 | 37 | 37 | 0 | 37 | 37 | 29.5 | 29.5 | 30.5 | 29.5 | 37.5 |
| Bulk density (g/l) | 325 | 330 | 335 | 300 | 335 | 335 | 335 | 335 | 335 | 335 | 335 |
| Moisture (wt. %) | 18 | 10 | 1 | 3 | 6 | 4 | 3 | 3 | 4 | 5 | 3 |
| Dust percent. (wt. %) | 2 | 4 | 8 | 5 | 7 | 8 | 6 | 5 | 5 | 5 | 7 |

% figures relate to the commercial form of the components including the usual water content.
*Cellulose having a fiber length of 150 μm,
**Linear polycarboxylate having an average molecular weight of 40,000.
***Crosslinked polycarboxylate having an average molecular weight of about 2 million.
#Polymer surfactant of acrylic acid/maleic acid with 10 wt. % of grafted alkyl polyglycoside.
Fatty alcohol surfactant (C12/14, EO = 4.7).
Carboxymethylcellulose
A roller-compacted cellulose from the company Degussa AG, having the trade name Elcema G 250 (5% moisture, bulk density 400 g/l), was used as Comparative Example C2.

Absorption of Liquid (Specific Porosity)

When comparing Example M2 according to the invention with Comparative Example C2, there were significant dissimilarities in the absorption of liquid, which resulted from the compacting process and the moisture content during compacting. When using the moisture content according to the invention during compacting and drying (M2), the result was 950 ml/kg absorption of DBP, while the sample C2 which had been dry-compacted and thus, compressed in its capillary structure, gave an absorption of only 600 ml/kg DBP.

Thus, it is found that the absorbing capacity of the disintegrant granulate of the invention is significantly increased compared to the comparative product.

Example 1

The strength and wash-in tests of a detergent tablet containing phosphate and using the granulates of the above-mentioned Examples are as follows:

TABLE 2

| Composition of the detergent tablet<br>Amount of raw material in % by weight | |
|---|---|
| Sodium tripolyphosphate | 35 |
| Sodium percarbonate | 19 |
| TAED | 4 |
| Fatty alcohol sulfate | 14 |
| Linear alkylbenzenesulfonate | 4 |
| Soda | 8 |
| Defoamer, optical brightener, CMC, phosphonate | 6 |
| Microcrystalline cellulose (200 μm) | 2 |
| Enzyme mix | 1 |
| Fatty alcohol ethoxylate C 12/14, EO = 4,7) | 2 |
| Disintegrant formulation according to Examples C1–C5 and M1–M7 | 5 |

Table 3 shows the strength and the results of wash-in tests of each detergent tablet, using various disintegrants.

TABLE 3

| Disintegrant of Example | Moisture (%) | Wash-in test (tablets not disint.) | Strength [N] | Disintegration time [s] |
|---|---|---|---|---|
| C1 | 18 | 10 | 61 | 50 |
| C2 | 5 | 10 | 58 | 52 |
| C3 | 10 | 6 | 60 | 40 |
| M1 | 6 | 1 | 62 | 12 |
| M2 | 4 | 0 | 65 | 9 |
| C4 | 1 | 3 | 58 | 25 |
| M3 | 3 | 0 | 57 | 8 |
| M4 | 3 | 1 | 63 | 10 |
| M5 | 4 | 1 | 58 | 9 |
| M6 | 5 | 0 | 59 | 7 |
| M7 | 3 | 0 | 58 | 9 |

Table 3 shows that both the composition and—in cases having the same composition—the moisture content of the disintegrant granulate have a significant effect on the tablet disintegration time. Indeed, disintegrants having the preferred content of 3–5 wt.-% of water, such as in M2, exhibit the best tablet disintegration times. By additionally incorporating other suitable swellable substances as disintegrant component, the disintegration properties can be enhanced even further.

Table 4 shows the effect of storage time (4 weeks at 40° C/60% humidity, closed receptacle) on the wash-in behavior of tablets including disintegrants.

TABLE 4

Phosphate-containing detergent tablet according to Table 2

| Example | Moisture of disintegrant [%] | Wash-in test (tablet) immediately | Wash-in test (tablet) after 4 weeks | Swelling kinetics after 3 seconds [mm] |
|---|---|---|---|---|
| C4 | 1 | 3 | 3 | 0.85 |
| M1 | 6 | 1 | 1 | 0.90 |
| M2 | 4 | 0 | 1 | 0.97 |
| C3 | 10 | 6 | 7 | 0.80 |
| C1 | 18 | 10 | 11 | 0.45 |
| C2 | 6 | 10 | 11 | 0.47 |
| M3 | 3 | 0 | — | 2.0 |
| M4 | 3 | 1 | — | 1.7 |
| M5 | 4 | 1 | — | 1.6 |
| M6 | 5 | 0 | — | 2.2 |

Table 4 shows that the inventive moisture content in the disintegrant granulate results in superior properties of the tablets produced therewith in the important wash-in test, and that the swellability, having values of 0.9 and more, is superior to that of comparative products.

Tablets having the disintegrant according to the invention show good storage stability. In addition to cellulose, tablets according to M3–M6 also include cellulose derivatives, and as a result, have further improved swelling kinetics.

Example 2

The strength and wash-in tests of detergent tablets free of phosphate using the granulates of the above-mentioned Examples are as follows:

TABLE 5

Granulate of Example M6/M7 in zeolite-based detergent formulations

| Amount of raw material in % by weight<br>Formulation | a) | b) |
|---|---|---|
| Zeolite P | 39 | 36 |
| Fatty alcohol ethoxylate (C12/14, EO = 4.7) | 4 | 7 |
| Sodium percarbonate | 16 | 16 |
| TAED | 4 | 4 |
| Fatty alcohol sulfate | 10 | 11 |
| Linear alkylbenzenesulfonate | 3 | 3 |
| Soda | 4 | 4 |
| Defoamer, optical brightener, CMC, phosphonate | 5 | 5 |
| Enzyme mix | 1 | 1 |
| Microcrystalline cellulose (200 μm) | 4 | 4 |
| Disintegrant formulation according to Examples C1, C2, M6, M7 | 5 | 5 |
| Sodium citrate | 5 | 5 |

TABLE 5.1

| Formulation | Disintegrant | Wash-in test | Strength [N] |
|---|---|---|---|
| a) | M6 | 1 | 57 |
| b) | M6 | 0 | 51 |
| a) | M7 | 0 | 73 |
| b) | M7 | 0 | 59 |
| Commercial tablet | | 1 | 30 |
| Commercial tablet | | 11 | 80 |
| a) | C1 | 10 | 58 |
| a) | C2 | 12 | 59 |

In this case as well, the comparative granulates C1 and C2 exhibit a significantly poorer properties compared to the inventive product of Example M6/M7. Commercially available tablets show varying dissolving behavior. Tablets having low strength undergo more rapid dissolution than those having high strength

TABLE 6

Granulate of Example M3 in disilicate-based detergent formulations

| Amount of raw material in % by weight<br>Formulation | a) | b) |
|---|---|---|
| Amorphous disilicate | 36 | 30 |
| Fatty alcohol ethoxylate | 2 | 7 |
| Fatty alcohol sulfate | 11 | 15 |
| Linear alkylbenzenesulfonate | 4 | 2 |
| Sodium percarbonate | 16 | 16 |
| TAED | 4 | 4 |
| Acrylate-maleate copolymer | — | 3 |
| Soda | 7 | 4 |
| Sodium citrate | 5 | 5 |
| Microcrystalline Cellulose (200 μm) | 4 | 4 |
| Defoamer, optical brightener, CMC, phosphonate | 5 | 4 |
| Enzyme mix | 1 | 1 |
| Disintegrant formulation according to Example M3 | 5 | 5 |

TABLE 6.1

| Formulation | Wash-in test | Strength [N] |
|---|---|---|
| a) | 0 | 65 |
| b) | 1 | 60 |

The granulate of Example M3 resulted in excellent disintegration times of tablets containing disilicate.

Example 3

Compressed moldings to be used as stain removing salt having the following composition:

TABLE 7

| Amount of raw material in % by weight | |
|---|---|
| Soda-disilicate cogranulate | 20 |
| Soda | 41 |
| Non-ionic surfactant | 4 |
| TAED | 7 |
| Enzyme mix | 1 |
| Sodium percarbonate | 24 |
| Disintegrant formulation according to Example M2 or C2 | 3 |

Softener, having the following composition

TABLE 8

| Amount of raw material in % by weight | |
|---|---|
| Zeolite | 15 |
| Sodium hydrogen carbonate | 32 |
| Citric acid | 20 |
| Polycarboxylate | 17 |
| Layer silicate | 8 |
| Processing aid | 5 |
| Disintegrant formulation according to Example M2 or C2 | 3 |

Machine dishwashing agent, having the following composition

TABLE 9

| Amount of raw material in % by weight | |
|---|---|
| Soda-silicate cogranulate | 20 |
| Tripolyphosphate | 35 |
| Soda | 20 |
| Sodium perborate | 12 |
| TAED | 4 |
| Enzyme mix | 2 |
| Processing aid | 3 |
| Perfume, dyes | 2 |
| Disintegrant formulation according to Example M2 or C2 | 2 |

Results regarding the strength and disintegration time of cleaning tablets.

TABLE 10

| Property Composition | Stain removing salt accordg. to a) | Water softener accordg. to b) | Machine dish-washing agent accordg. to c) |
|---|---|---|---|
| Strength [N] | 175 | 210 | 185 |
| Disintegration time [s] with disintegrant C2 | 225 | 145 | 245 |

TABLE 10-continued

| Property Composition | Stain removing salt accordg. to a) | Water softener accordg. to b) | Machine dish-washing agent accordg. to c) |
|---|---|---|---|
| Disintegration time [s] with disintegrant M2 | 85 | 68 | 58 |

The tablet disintegration time of highly compacted tablets including the disintegrant of the invention is superior to that of comparative products.

Examples 4 and C7

Effect of High Surfactant Content on the Properties of Disintegrant Granulates

A granulate according to the invention (M2) having a content of nonionic surfactant of 0.5 wt.-% is compared with a granulate of same formulation and manufacturing technology, wherein the nonionic surfactant content has been increased to 12 wt.-% (C7).

The following Table 11 shows the swelling kinetics of both granulates after a swelling time of 3.5 and 10 seconds.

TABLE 11

| | Path of swelling [mm] after | | |
|---|---|---|---|
| Example | 3 s | 5 s | 10 s |
| M2 | 0.97 | 1.0 | 1.1 |
| C7 | 0.33 | 0.42 | 0.44 |

The abrasion of the two samples M2 and C7 was compared in another test.

TABLE 12

| Abrasion test on samples M2 and C7 | |
|---|---|
| Example | Grain fraction <1 mm in % by weight |
| M2 | 10 |
| C7 | 35 |

The results indicate that disintegrant granulates having a surfactant content outside the design according to the invention have significantly poorer characteristics both in swelling behavior and abrasion resistance.

Obviously, numerous modifications and variations of the present invention are possible in light of the above teachings. It is therefore to be understood that within the scope of the appended claims, the invention may be practiced otherwise than as specifically described herein.

The priority document of the present application, European patent application EP 99 106 370.2 filed Mar. 29, 1999, is incorporated herein by reference.

What is claimed is:

1. A compacted disintegrant granulate for tablets, consisting of:

A) 60–99 wt.-% of a water-insoluble cellulose which is swellable in water;

B) 1–40 wt.-% of at least one polymeric binder of a polymer or a copolymer of (meth)acrylic acid and/or salts thereof;

C) 0–7 wt.-% of at least one liquid surfactant which forms a gel with water, wherein the sum of A), B) and C) amounts to 100 wt.-%, and the disintegrant granulate has a moisture content of from 2 to 8 wt.-%.

2. The disintegrant granulate of claim 1 having 1–15 wt.-% of polymeric binder and from 0.1 to 3.5 wt.-% of the surfactant.

3. The disintegrant granulate of claim 1, wherein the surfactant is at least one member selected from the group consisting of non-ionic, anionic, and amphoteric surfactants, and mixtures thereof.

4. The disintegrant granulate of claim 1, wherein the surfactant is at least one surfactant selected from the group consisting of fatty alcohol ethoxylates having from 3 to 15 mol of ethylene oxide, fatty alcohol sulfates, linear alkylbenzenesulfonates, alkyl ether sulfates, alkylpolyglycosides, and mixtures thereof.

5. The disintegrant granulate of claim 1, wherein the granulate has a moisture content of from 3 to 5 wt.-%.

6. The disintegrant granulate of claim 1 having at least one regenerated cellulose.

7. The disintegrant granulate of claim 1, wherein prior to compacting, the cellulose is present in the form of finely divided particles having particle sizes between 0.03 and 3 mm.

8. The disintegrant granulate of claim 1, wherein the polymeric binder is selected from the group consisting of homopolymers of (meth)acrylic acid and copolymers of (meth)acrylic acid with at least one of ethylenically unsaturated dicarboxylic acids, unsaturated dicarboxylic acid anhydrides, ethylenically unsaturated sulfonic acids, acrylic esters, vinyl esters, vinyl ethers, saponification products of vinyl ethers, crosslinkers, graft base materials based on polyhydroxy compounds, and mixtures thereof.

9. The disintegrant granulate of claim 1, wherein the granulate has a particle size of from 0.05 to 3 mm.

10. The disintegrant granulate of claim 1, wherein the granulate has a particle size of from 0.1 to 1.5 mm.

11. The disintegrant granulate of claim 1, wherein the granulate has a porosity of from 800 to 1000 ml/kg.

12. The disintegrant granulate of claim 1, wherein the granulate has a bulk density of from 250 g/l to 400 g/l.

13. A process for manufacturing the disintegrant granulates of claim 1 comprising:

mixing the components of the granulate to form a primary mixture, adjusting primary mixture to a moisture content of from 10 to 80 wt.-%, compacting the primary mixture, drying the compacted primary mixture to a moisture content of from 2 to 8 wt.-%, and optionally, milling and screening the dried, compacted primary mixture to a desired grain size distribution.

14. The process of claim 13, wherein said compacting is carried out using at least one of rollers under friction, roller or cube presses, extruders, ring matrix presses, and pelletizing presses.

15. The process of claim 13, wherein said compacting is effected to a moisture content of from 20 to 40 wt.-% using ring matrix or pelletizing presses.

16. The process of claim 13, wherein the moisture content after drying is 3–5 wt.-%.

17. A tablet comprising the disintegrant granulate of claim 1.

18. The tablet of claim 17 having a breaking strength of up to 80 N and a tablet disintegration time of up to 15 seconds.

19. A compacted disintegrant granulate for tablets, consisting of:

A) 60–99 wt.-% of a water-insoluble cellulose which is swellable in water and at least one modified water-swellable polysaccharide derivative;

B) 1–40 wt.-% of at least one polymeric binder of a polymer or a copolymer of (meth)acrylic acid and/or salts thereof;

C) 0–7 wt.-% of at least one liquid surfactant which forms a gel with water, wherein the sum of A), B) and C) amounts to 100 wt.-%, and the disintegrant granulate has a moisture content of from 2 to 8 wt.-%.

20. The disintegrant granulate of claim 19, wherein the granulate has a moisture content of from 3 to 5 wt.-%.

21. The disintegrant granulate of claim 19, wherein the amount of water-swellable polysaccharide derivative is from 5 to 50 wt.-% of the amount of cellulose present in the granulate.

22. The disintegrant granulate of claim 19, wherein the water-swellable polysaccharide derivatives are polysaccharides selected from the group consisting of cellulose derivatives, starch derivatives and polygalactomannan derivatives, said derivatives having anionic groups, and/or non-ionic groups, and/or modified by physical and/or chemical crosslinking.

23. The disintegrant granulate of claim 22, wherein said polysaccharide derivatives are selected from the group consisting of carboxymethylcellulose, carboxymethylstarch, hydroxyalkylcellulose, hydroxyalkylstarch, alkylcellulose, guar meal and locust bean seed meal, and mixtures thereof.

24. The disintegrant granulate of claim 19, wherein prior to compacting, the cellulose and polysaccharide derivatives are present in the form of finely divided particles having particle sizes between 0.03 and 3 mm.

25. The disintegrant granulate of claim 19, wherein the granulate has a particle size of from 0.1 to 1.5 mm.

26. The disintegrant granulate of claim 19, wherein the granulate has a porosity of from 800 to 1000 ml/kg.

27. A compacted disintegrant granulate for tablets, consisting of:

A) 60 –99 wt.-% of a water-insoluble cellulose which is swellable in water,

D) 1–40,wt.-% of at leas one polymeric binder, wherein the sum of A) and D) amounts to 100 wt.-%, wherein the disintegrant granulate has a moisture content of from 2 to 8 wt.-%, and the polymeric binder D) is a polymer surfactant.

28. The disintegrant granulate of claim 27, wherein the granulate has a moisture content of from 3 to 5 wt.-%.

29. The disintegrant granulate of claim 27, wherein the granulate has a particle size of from 0.1 to 1.5 mm.

30. The disintegrant granulate of claim 27, wherein the granulate has a porosity of from 800 to 1000 ml/kg.

31. The disintegrate granulate of claim 27, wherein the polymer surfactants have a polymer backbone of alkylene oxide moieties.

32. A compacted disintegrant granulate for tablets, consisting of:

A) 60–99 wt.-% of a water-insoluble cellulose which is swellable in water and at least one modified water-swellable polysaecharide derivative, D) 1–40 wt.-% of at least one polymeric binder, wherein the sum of A) and D) amounts to 100 wt.-%, wherein the disintegrant granulate has a moisture content of from 2 to 8 wt.-%, and the polymeric binder D) is a polymer surfactant.

33. The disintegrant granulate of claim 32, wherein the granulate has a moisture content of from 3 to 5 wt.-%.

34. The disintegrant granulate of claim 32, wherein said polysaccharide derivatives are selected from the group consisting of carboxymethylcellulose, carboxymethylstarch, hydroxyalkylcellulose, hydroxyalkylstarch, alkylcellulose, guar meal and locust bean seed meal, and mixtures thereof.

35. The disintegrant granulate of claim 32, wherein the granulate has a porosity of from 800 to 1000 ml/kg.

* * * * *